United States Patent [19]

Cammarata, III et al.

[11] 4,090,541

[45] May 23, 1978

[54] FLEXIBLE COLLAPSIBLE CONTAINER

[75] Inventors: Frank Cammarata, III, Palatine; Joe A. Miller, Lake Zurich; Philip G. Ralston, Jr., Woodstock, all of Ill.

[73] Assignee: Baxter Travenol Laboratories, Inc., Deerfield, Ill.

[21] Appl. No.: 744,230

[22] Filed: Nov. 23, 1976

[51] Int. Cl.[2] ..... B65D 1/02

[52] U.S. Cl. ..... 150/.5; 222/107

[58] Field of Search ..... 150/.5, 1; 229/DIG. 4; 222/107

[56] References Cited

U.S. PATENT DOCUMENTS

| | | | |
|---|---|---|---|
| 3,081,002 | 3/1963 | Tauschinski | 222/107 X |
| 3,288,334 | 11/1966 | Corsette | 222/107 |
| 3,319,684 | 5/1967 | Calhoun | 150/1 X |
| 3,353,714 | 11/1967 | Trecek | 222/107 |
| 3,406,873 | 10/1968 | Zackheim | 222/107 |
| 3,595,441 | 7/1971 | Grosjean | 150/.5 X |

*Primary Examiner*—Donald F. Norton
*Attorney, Agent, or Firm*—Paul C. Flattery; John P. Kirby, Jr.; Gary W. McFarron

[57] ABSTRACT

A flexible, collapsible container having walls essentially 0.01 to 0.03 inch thick and defining relatively thin lines of folding weakness in the container to facilitate flat collapse. The thickness of the lines of folding weakness is less than that of the surrounding walls. The cross-sections of the lines of folding weakness define arcs, the outer surfaces of which have a circumferential length which is 40 to 60 percent greater than the direct width of the lines of folding weakness. Preferably, the container is made of a relatively stiff polyolefin plastic such as polyethylene, polypropylene, or copolymers thereof of similar stiffness, particularly biaxially oriented materials.

7 Claims, 12 Drawing Figures

FIG. 8
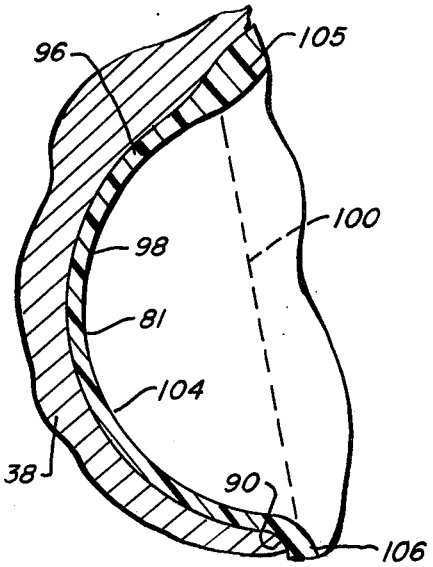
FIG. 6
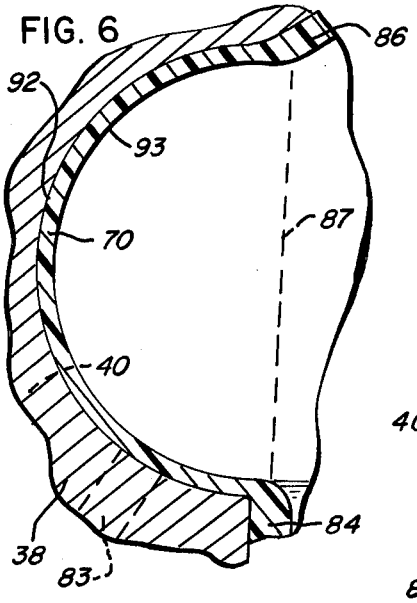
FIG. 1
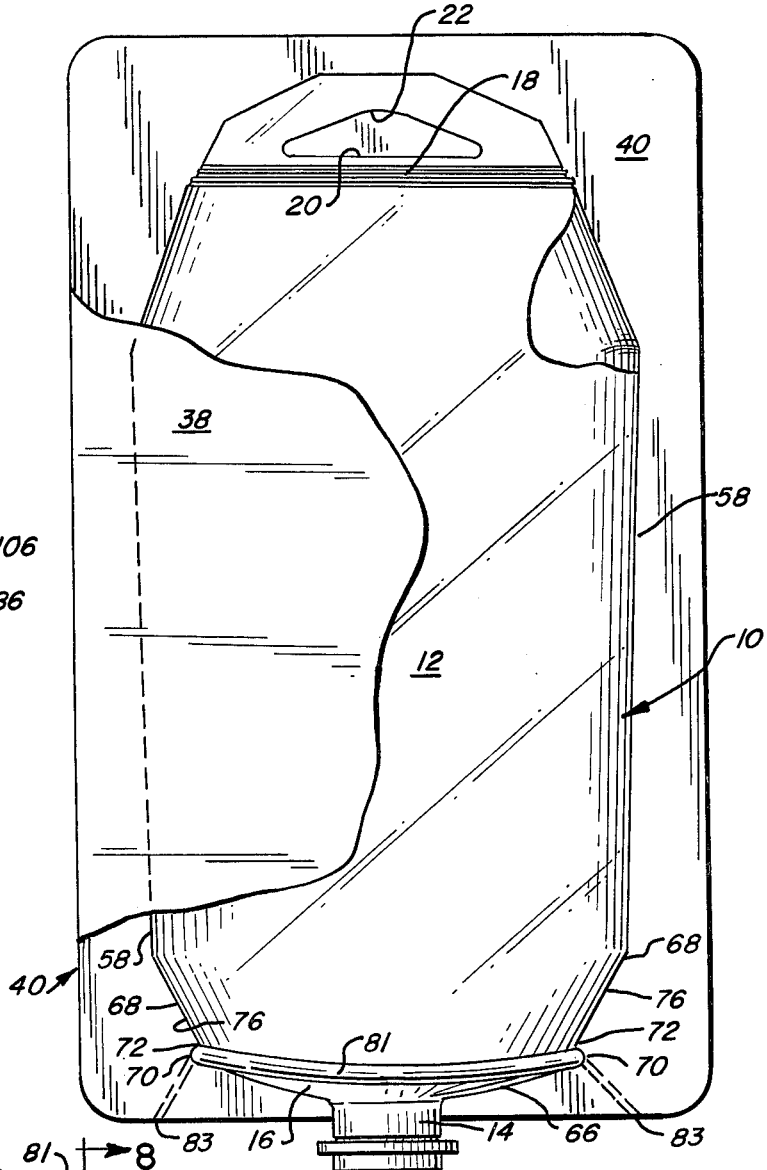
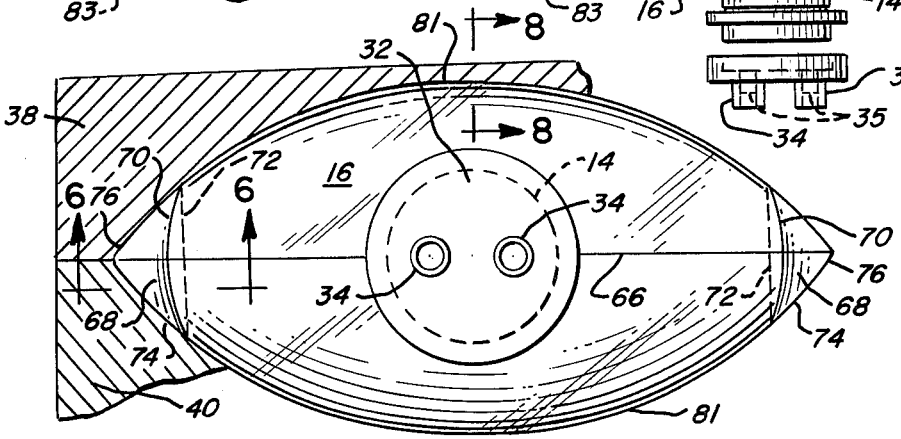
FIG. 2

FIG. 3
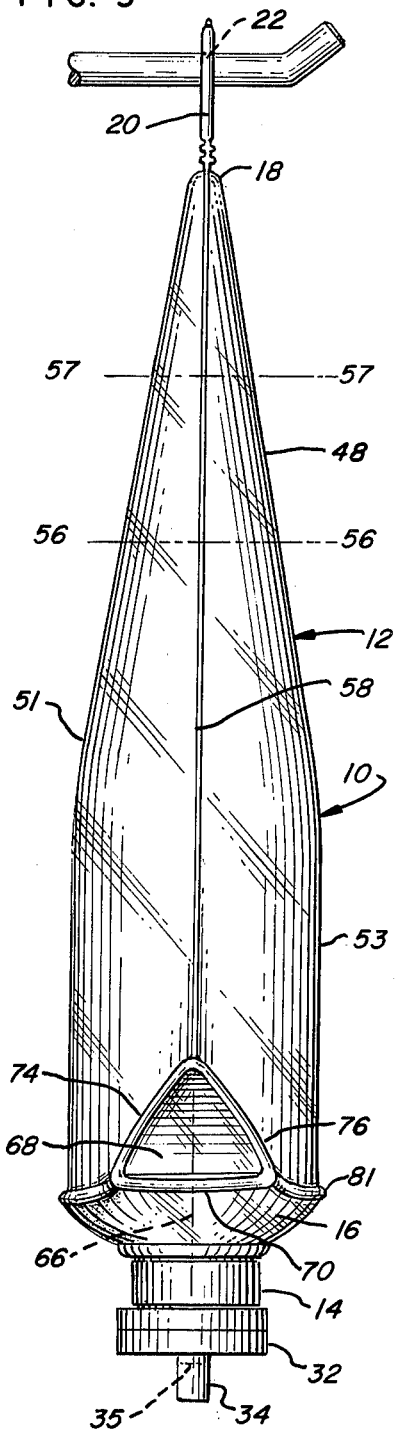
FIG. 4
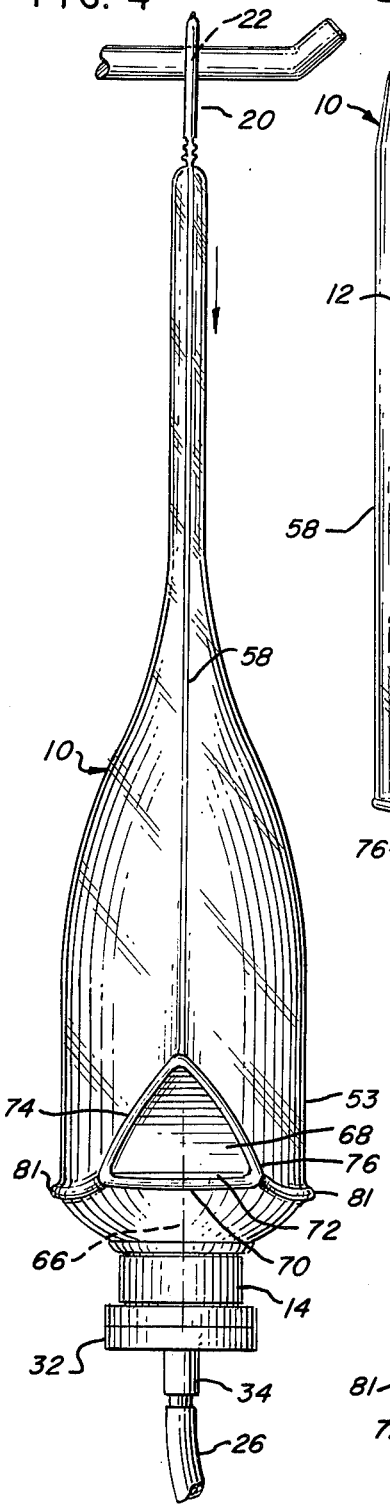
FIG. 5
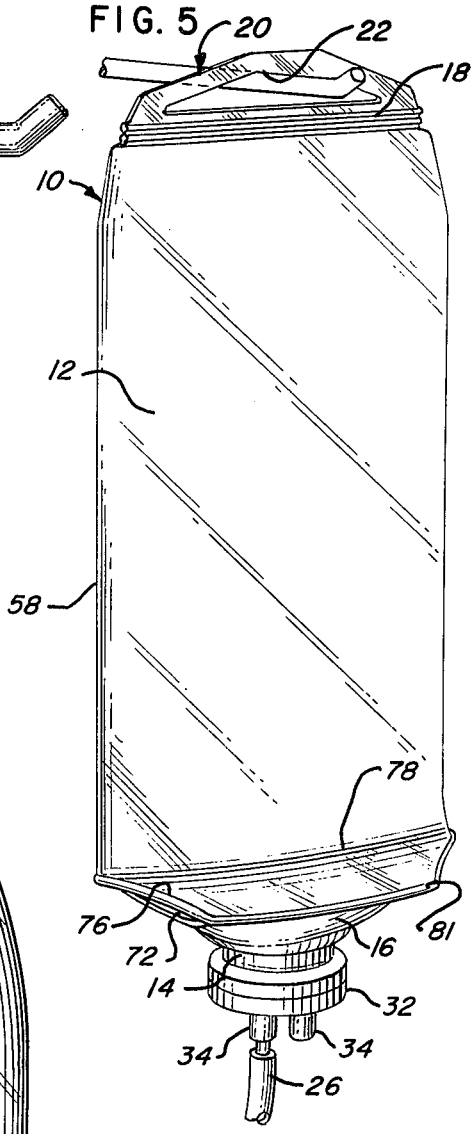
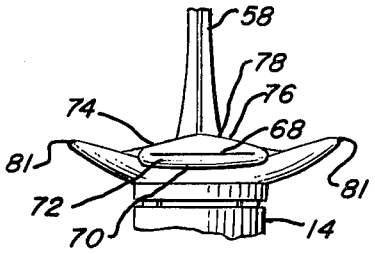
FIG. 5A

FIG. 5B
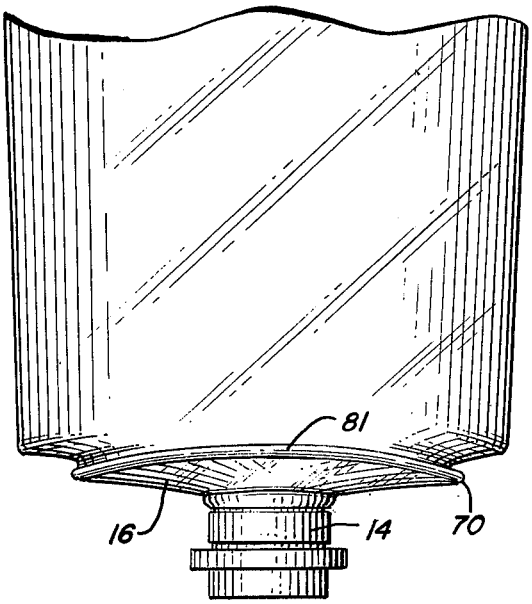
FIG. 10
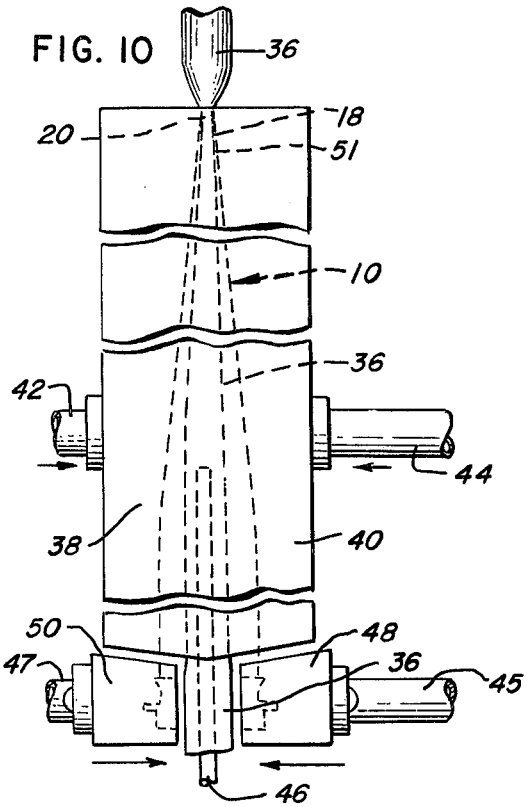
FIG. 7
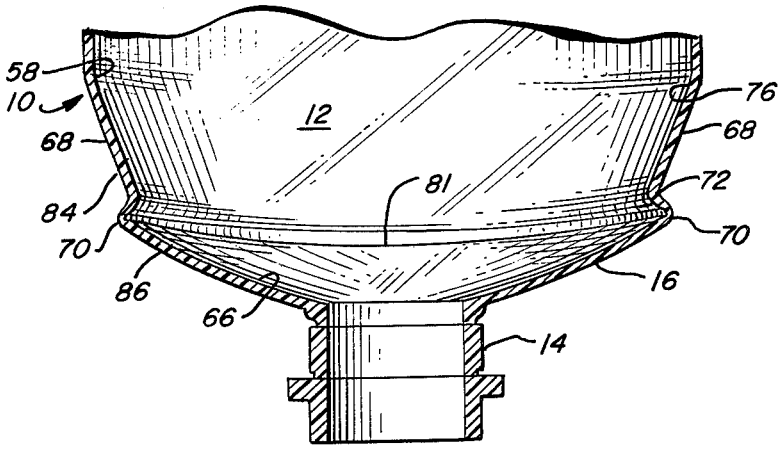
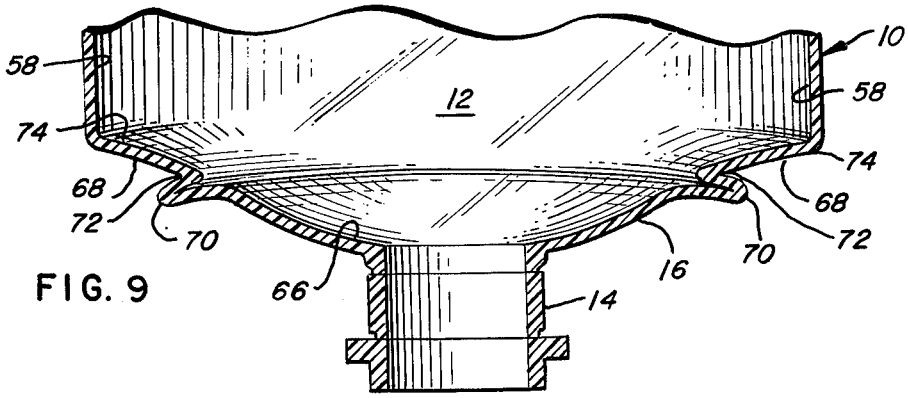
FIG. 9

FLEXIBLE COLLAPSIBLE CONTAINER

BACKGROUND OF THE INVENTION

Flexible plastic parenteral solution containers are presently sold by Travenol Laboratories, Inc. under the trademark VIAFLEX®. These containers have many substantial advantages over glass bottles of parenteral solution, particularly in their reduced weight, lack of susceptibility to breakage, and freedom from the need to allow air to bubble into the solution container as it drains.

The presently available plastic parenteral solution bags are made of a pair of flat sheets of polyvinyl chloride plastic, heat-sealed at their edges to form a sealed, sterile container. In the past, various attempts have been made to replace the heat-sealed plastic solution containers with blow molded containers. However, one drawback to the use of such blow molded containers is the fact that, when hung from one end with solution being drawn out of them from the other end, they tend to collapse in an incomplete manner. This is particularly so when relative stiff polymers, e.g., polyolefins such as polyethylene or polypropylene, are used.

The reason for this incomplete collapse is that the stiffness of a thin-walled polypropylene container frequently tends to resist collapse to such a degree that the moderate suction pressure exerted on the container by weight of the fluid in an administration set attached to the container is insufficient to cause its complete collapse.

Another disadvantage of certain prior art solution containers made from blow-molded parisons is that they may collapse in a non-uniform manner. On some occasions these devices, which are generally oval in shape, collapse along the long axis of their oval cross-section, but on other occasions they tend to collapse along both the short axis of the cross-section as well as the long axis. As a result of this, it becomes quite difficult for a nurse to determine exactly how much solution has passed out of the solution container.

Also, it is desirable to provide containers for parenteral solution delivery and the like which collapse flat over essentially all of their length, so that the entire liquid contents of the container can be expelled, and only a small, residual amount of air, for example less than 5 percent of the volume of the container, remains therein. The maximum air volume of 5 percent is better appreciated when it is understood that this also approximates the volume of typical parenteral solution administration equipment, when a 1 liter bag is used. This is much superior to semicollapsible containers which exhibit a large air volume of a hundred c.c. or more per liter, avoiding the possibility of large amounts of air entering the solution administration tubing to pass to the patient.

In accordance with this invention, a collapsible parenteral solution container is provided which can advantageously be made of stiffer, more desirable plastic material such as polypropylene, while still being readily completely collapsible in normal therapeutic use as a dispenser of parenteral solution. Also, the novel container of this invention collapses in a uniform manner, which simplifies the determination of the amount of fluid remaining in the container at any time. Likewise, the container can collapse essentially completely under normal suction exerted by the suction head of solution in the administration set.

DESCRIPTION OF THE INVENTION

In accordance with this invention, a flexible, collapsible solution container, preferably having walls of essentially 0.01 to 0.03 inch thickness, defines relatively thinned lines of folding weakness therein to facilitate flat collapse. The thickness of the lines of folding weakness is less than that of the surrounding walls, with the cross-sections of the lines of folding weakness defining arcs. The circumferential length along the interior of the cross-sectional arcs is from 40 to 60 percent greater than the direct width of the lines of folding weakness.

Thus, while thinned folding lines in containers have been previously known, the thin-walled, collapsible container of this invention, defining lines of folding weaknesses, having cross-sectional arcs of the particular shape and relationships described, provides a spontaneously collapsible container which can be designed to collapse essentially flat under a negative or suction pressure differential between the inside and outside of the container of as little as 20 inches of water. This permits the container to be used in conventional parenteral solution therapy in which such a suction pressure differential can be provided simply by elevating the container of this invention over the patient's arm at a usual height.

As stated above, the container of this invention is advantageously made from polyethylene, polypropylene, or copolymers thereof which are of approximately equal or greater stiffness, for example, materials having a plastic flexural modulus of at least 60,000 according to the test of ASTM D790, (secant modulus of elasticity) and preferably no more than about 250,000. Such inert, relatively stiff and strong materials permit the use of extra thin flexible walls in the container of this invention, which are generally free of leachable materials. The walls of the container of this invention flex as they collapse, although the flexing is primarily focused at the lines of folding weakness utilized herein.

Accordingly, the desirable characteristics of the strong, inert, and inexpensive polyethylene and polypropylene-type polymers are combined with a container which collapses flat with ease.

The preferred containers of this invention define a body portion having an integral neck portion and a semi-rigid shoulder portion. It is preferred for lines of folding weakness in accordance with this invention to be positioned along the edges of the shoulder portion, most preferably essentially surrounding the shoulder portion about the edges of the shoulder portion, which is generally of oval shape, but preferably with slight flattening on opposite ends thereof.

Preferably, the minimum wall thickness within the lines of folding weakness is from 40 to 70 percent of the thickness of the container wall adjacent the lines of folding weakness.

It is generally desirable for the overall thickness of the container wall to increase from about 0.01 inch near the end thereof which is remote from the neck and shoulder portions, to a thickness of about 0.02 inch at the shoulder portions, but thinner at the ends of the shoulder portions. In this instance, the lines of folding weakness are preferably from about 0.005 to 0.01 inch in thickness about the edges of the shoulder portions.

Preferably, the container of this invention is biaxially oriented in its fabrication, which may be by blow molding as a preferred fabrication technique, in accordance with well-known technology.

In the drawings, one preferred specific embodiment of the solution container of this invention is shown.

FIG. 1 is an inverted, elevational view of the solution container of this invention in as-molded configuration, resting in the mold used to manufacture the container, with portions of the mold broken away to show the solution container inside.

FIG. 2 is a plan view of the solution container of this invention, showing the neck and shoulder portions thereof.

FIG. 3 is an elevational view of the solution container of FIG. 1, inverted in its typical position of use.

FIG. 4 is an elevational view similar to FIG. 3, after approximately one-half of the liquid contents have been removed from the solution container.

FIG. 5 is a perspective view after essentially all of the liquid contents have been removed from the container of this invention, showing how the bottom of the container collapses under the influence of a normal suction of a column of parenteral solution in an attached administration set.

FIG. 5A is a fragmentary elevational view of the shoulder portion of the container of FIG. 5.

FIG. 5B is a similar elevational view as FIG. 5A, rotated by 90° along the longitudinal axis of the container.

FIG. 6 is an enlarged, sectional view, taken along line 6—6 of FIG. 2, showing a detail of the mold for producing the container.

FIG. 7 is an enlarged, fragmentary, elevational view, taken in longitudinal section, of part of the container of FIG. 2 when under the condition of FIG. 3.

FIG. 8 is an enlarged sectional view taken along line 8—8 of FIG. 2, also showing portions of the mold for producing the container.

FIG. 9 is an enlarged, fragmentary, elevational view, taken in longitudinal section, of part of the container of FIG. 1 when under the condition of FIG. 5.

FIG. 10 is a schematic, elevational view showing how the mold of this invention is used in a blow molding operation to manufacture the container of FIG. 1.

Referring to the drawings, a molded, collapsible solution container 10 is disclosed which defines a body portion 12 having an integral neck portion 14 and shoulder portion 16 of one end thereof. Neck and shoulder portions 14, 16 are preferably made of material thick enough to be relatively stiff, while the rest of the container is thin enough to be flexible and collapsible. Container 10 is sealed at its end 18 opposite the neck and shoulder portions 14, 15 and includes a flattened portion 20 having a hangar hole 22 so that the container may be hung up for convenient administration of parenteral solution or any other material as desired.

Neck portion 14 of container 10 is proportioned to receive a cap portion 32, which may be attached to the neck portion by heat welding or the like. Cap portion 32 is generally made of semi-rigid plastic, and is shown to contain a pair of tubular access ports 34 which, prior to opening, are occluded by diaphragms 35 across the bores of the tubular ports. Accordingly, container 10 is opened by inserting a sterile, hollow spike of an administration set into one of the access ports 34 to rupture the diaphragm. The spike is selected to be proportioned for sealing, sliding contact with the interior of port 34, so that solution passes only through the hollow spike and into the administration set.

The other of the two access ports 34 may carry a latex injection site for the administration of supplemental medication or the like to the contents of container 10.

As shown in FIG. 1, container 10 is typically molded without cap 32, the cap being added later.

FIG. 10 schematically shows a blow molding apparatus which is used to manufacture the collapsible container of this invention. Blow molding in general is a well developed arm of technology, and many different techniques of blow molding are currently available to those skilled in the art, and useable for manufacturing the containers of this invention. In particular, the well-known Orbet process, which is available under license from the Phillips Petroleum Company of Bartlesville, Oklahoma, is a highly suitable manufacturing process for the container of this invention.

A tubular parison 36 of hot, soft plastic is lowered into mold halves 38, 40, and neck mold portions 48, 50, which are then brought together by pistons 42, 44, 45, 47. A blowing tube 46 is introduced into the mold at an appropriate time during the process, and air is introduced to expand the hot parison outwardly until it is stretched to match the configuration of the interior of closed mold halves 38, 40. The formed container within mold halves 38, 40 is allowed to cool. Thereafter, blow tube 46 may be withdrawn; the molds opened; and the container ejected.

Flattened portion 20 is formed by an end of mold halves 38, 40 as shown in FIG. 10.

Accordingly, the flexible container of this invention, in as-molded configuration, assumes the novel shape of the mold cavity shown herein in FIGS. 1 and 10, with that shape being more fully disclosed in FIGS. 1, 2, 3, and 7.

After cooling, the respective mold halves are opened, and container 10, exhibiting the as-molded configuration shown in the previously mentioned figures, is removed.

The solution container, in as-molded configuration, defines a generally oval, transverse cross-section adjacent the neck and shoulder portions 14, 16 as generally shown in FIG. 2. As shown in FIG. 3, this cross-section tapers progressively in container section 48 to generally flat configuration at the end 18 of the container which is opposite from the end having neck and shoulder portions 14, 16. In this specific embodiment, the tapered section 48 begins at point 51, being spaced from shoulder portion 16 by an optional length of parallel walled container section 53, which preferably extends less than half of the container length, so that section 48 constitutes a major portion of the container.

The purpose of tapered section 48 is to facilitate a uniform manner of flat collapse of the container progressively from end 18 towards the neck and shoulder end of the container, as the contents thereof are withdrawn through neck portion 14, when the container is disposed in neck-downward position. This effect is progressively illustrated in FIGS. 3, 4 and 5.

The container of this invention thus collapses reliably in a uniform manner, which permits the nurse to accurately judge how much parenteral solution has been expended from the collapsible container by no more than a quick glance, rather than having to manipulate the bag or carefully examine it, as is the case in the prior art flexible containers.

The shape of the bag of FIG. 3 is idealized, in that the specific shape shown shows the bag in as-molded condition for purposes of illustration. Actually the pressure of the liquid in the container would cause the inverted container of FIG. 3 to be a little fatter at the bottom, and thinner at the top, than is shown in that figure.

It can be seen from FIG. 1 that the lateral edges 58 of container 10 are not parallel, but diverge slightly over most of their length in the direction running from the end of the container carrying neck 14, to end 18. This is an aspect of the shape of the container 10 which causes, along a major portion of the length of the container, the circumferences of all axially perpendicular, transverse cross-sections to be essentially constant.

Accordingly, as container 10 gets thinner in its transverse dimension (illustrated in FIG. 3) as one moves toward end 18, it correspondingly becomes wider in its lateral dimension as shown in FIG. 1 as one moves toward the same end 18. As a result, the peripheral length or circumferences of most transverse cross-sections, perpendicular to the container's longitudinal axis, will be essentially constant. For example, transverse sections 56 and 57 will be essentially uniform in peripheral length or circumference.

The wall thickness of the containers of this invention preferably varies from about 0.025 to 0.01 inch. It is generally preferable for the wall thickness at end 18 to be about 0.01 inch, with the wall thickness increasing gradually to a maximum of about 0.02 inch in the area of shoulder portion 16.

Furthermore, a pair of longitudinal lines of flexing weakness 58 may optionally be defined along both lateral container edges, to further facilitate the flat collapse of container 10.

The plane of flat end 18 of container 10 is preferably parallel to the long axis 66 of the oval shoulder area 16 as shown in FIG. 3. This also facilitates uniform, flat collapse.

Generally triangular gusset portions 68 are provided adjacent shoulder portion 16, and in recessed relation thereto, so that shoulder tips 70 protrude outwardly from the gusset portions.

As shown in FIG. 6, shoulder tips 70 define a thin line of flexing weakness, which facilitates the collapse of the container of this invention in the manner illustrated in FIG. 9, where shoulder tip 70 is shown to collapse into a more acute angle to allow gusset portions 68 to fold outwardly toward the horizontal, and to allow the collapsing container to fold inwardly at area 78 as shown in FIGS. 5 and 5A.

The wall thickness of the polypropylene or other plastic at the tip of shoulder 70 is preferably from 40 to 70 percent of the wall thickness immediately adjacent to the line of weakness defined by shoulder 70. Therefore, the thinned portion serves as a desirable folding line of weakness to facilitate the low pressure collapse of this container. For example, the thinnest wall thickness at shoulder 70 may be about 0.005 to 0.007 inch, while area 84 adjacent the shoulder tip may be about 0.008 to 0.013 inch, and area 86, on the shoulder proper, may be about 0.008 to 0.013 inch thick. Also, the direct width 87, measured across the width of the generally cylindrical wall section defining each shoulder tip line of weakness 70, may preferably be 0.2 to 0.3 inch. The length of generally circular arc 93, measured from the ends of direct width 87, may be about 0.28 to 0.48 inch.

Specifically, the thinnest portion of shoulder 70 may be from 0.0055 to 0.0065 inch. Area 86 may be 0.008 to 0.01 inch in thickness, while area 84 may be 0.011 inch thick. Direct width 87 may be 0.25 to 0.26 inch long. Arc 93 may be, in this circumstance, preferably about 50 percent greater than the specific direct width 87.

This thinned line of weakness 70 may be obtained by molding by defining a corresponding groove 92 in the mold, as shown in FIG. 6, of structure complementary to the desired shape of the shoulder and thinned line 70. Therefore, as expanding tubular parison 36 comes into contact with the walls of the mold halves 38 and 40, it tends to quickly cool and harden. The expanding parison first encounters mold halves 38, 40 at areas 84, 86, and in those areas the parison hardens quickly and becomes immobile. However, the mold halves define groove or cutaway portion 92 of the mold, a generally cylindrical section, into which the parison can still expand, and in so doing it reduces its wall thickness as indicated. Eventually, the parison fills the cutaway portion 92, but here its expansion forms a linear portion which defines an arc 93 in cross-section where, preferably the circumferential length of the inner surface of each cross-sectional, generally circular arc is from 40 to 60 percent greater than the direct width 87 of the line of folding weakness itself, measured from the points of intersection of the arc and direct width 87. The minimum thickness of the container wall in the line of folding weakness so defined is preferably from 40 to 70 percent of the thickness of adjacent walls.

Each gusset portion 68 is bounded by three side portions 72, 74, 76, which may also define lines of flexing weakness optionally formed in a manner similar to the above. However, line 72 defines an angle pointing inwardly toward the interior of the bag, while lines 74 and 76 may be lines of weakness having an outwardly pointing, circular, or U-shaped arcs in cross-sectional structure corresponding to that shown in FIG. 6. Lines of weakness 74, 76 may be formed by appropriate grooves in the mold halves (for forming lines 74, 76) and by appropriate ridges in the mold half for forming lines 72. Also, lines of flexing weakness 58, 72, 74 and 76 may simply constitute crease lines molded into the bag wall by appropriate grooves or ridges in the mold.

The gusset structure and lines of weakness used herein permit the further collapse under normal suction pressure of the type exerted within the container due to the weight of the solution in administration set 26 and the normal elevation of the container as used. The container collapses both longitudinally and laterally in the region of gussets 68, adjacent shoulders 16, which further reduces the volume of the collapsed container, and permits the expulsion of more parenteral solution. This is particularly illustrated by FIGS. 4 and 7, when compared with FIGS. 5 and 9.

The side edges of shoulder portion 16 each define a transverse line of folding weakness 81, which facilitates the collapse of the container of this invention as particularly illustrated in FIGS. 5 and 5A.

Line of folding weakness 81 may be constructed by a groove 96 in the mold as shown by FIG. 8 in a manner similar to the way that groove or cutaway portion 92 forms the thinned line of weakness at shoulder 70. Once again, cutaway portion 96 causes the expanding parison to freeze about the edges of the cutaway portion, resulting in stretching and thinning of the parison as it passes into groove 96 to form the thinned shoulder lines of weakness.

It is once again preferred for the cross-sections of the lines of weakness 81 about the shoulder to define generally circular arcs 98, in which the circumferential length of the inner surface of each arc 98 is from 40 to 60 percent greater than the direct width 100 of the lines of folding weakness, measured between the intersections of arc 98 and width 100. This particular range of curvature relationship provides particularly effective folding action, to permit flat collapse to a residual volume of no more than 5 percent of the original volume of the container, for example for a 1 liter container, about 30 c.c. of air and very few additional c.c. of liquid. The shape of groove 96 in the mold governs the resulting shape of line of folding weakness 81, as shown.

It is preferred with respect to both lines of folding weakness 81 and 70 that each of the lines of folding weakness are single lines, free of folding lines parallel thereto within a distance of three times the direct width of the lines of folding weakness.

The thickness of the thinnest portion of the container wall in line of folding weakness 81 is also preferably from 40 to 70 percent of the thickness of the container wall adjacent the line of folding weakness. As shown here, by way of example, the wall thickness at point 104 in the line of folding weakness may be about 0.008 to 0.013 inch, while points 105 and 106, adjacent to the outside of the line of folding weakness, may be about 0.011 to 0.033 inch thick. The direct width 100 of line of weakness 81 may be, for example, 0.14 to 0.18 inch.

Specifically, the thinnest portion of line of folding weakness 81 at point 104 may be from 0.0085 to 0.01 inch, while the thickness of the plastic at point 105 may be from 0.018 to 0.019 inch thick, and at point 106 it may be from 0.016 to 0.017 inch in thickness. The direct width 100 of line of weakness 81 may specifically be 0.15 to 0.16 inch wide.

The length of arc 110, measured from the ends of direct width 100, may preferably be about 0.19 to 0.29 inch, and most preferably about 50 percent greater than the specific dimension of direct width 100.

Shoulder portion 16 is essentially surrounded by the lines of folding weakness 70, 81 as defined in this invention, to provide a uniquely collapsible container which can collapse flat under a reduced or negative pressure differential of about 20 inches of water to empty at least about 95 percent of the container contents.

Mold halves 38 and 40 desirably contain vent channels 83 which communicate with the respective grooves in its mold half which form the various lines of flexing weakness, particularly those grooves which are not on the parting line of the mold. Vents 83 permit air to escape from grooves formed in the mold halves to define various lines of weakness, so that the lines of weakness in the container wall can expand more fully into the grooves which are so formed.

The flexible container of this invention can be easily molded, filled with parenteral solution or any other desired product and sterilized if necessary by autoclaving, particularly when the container of this invention is made of a high melting plastic such as polypropylene. When the contents are drained from the inverted container, the container collapses in a uniform manner to permit the accurate measurement of the amount of solution withdrawn from the container, even though the container includes less residual air than has been previously required in order to conveniently read the amount of liquid expended from the container.

The above has been offered for illustrative purposes only, and is not intended to limit the invention of this application, which is as defined in the claims below.

That which is claimed is:

1. A flexible, collapsible container having a generally rigid and oval neck and shoulder portion, connected to flexible walls of essentially 0.01 to 0.03 inch thickness, and defining relatively thinned lines of folding weakness in said container to facilitate flat collapse, the thickness of said lines of folding weakness being less than said surrounding walls, the cross-sections of said lines of folding weakness defining arcs, the circumferential length of the outer surface of each of said arcs being from 40 to 60 percent greater than the direct width of said lines of folding weakness, said lines of folding weakness being positioned about essentially all edges of said shoulder portion, the thinnest wall within said lines of folding weakness being from 40 to 70 percent of the thickness of the container wall adjacent said lines of folding weakness, in which the wall thickness at the ends of said oval shoulder, positioned transversely to the long axis of said oval shoulder is thinner than the edges of said oval shoulder positioned longitudinally of said long axis, whereby said container is collapsible under a negative pressure differential of 20 inches of water, to allow reduction of the internal volume of said container by at least 95 percent.

2. The container of claim 1 which is made of a plastic material having a plastic flexural modulus of at least 60,000, according to ASTM test D790.

3. The container of claim 2 in which said lines of folding weakness positioned along the edges of said shoulder portion are single lines of folding weakness, free of folding lines parallel thereto within a distance of three times the said direct width of said lines of folding weakness.

4. The container of claim 3 in which the end opposite said neck and shoulder portion is sealed in flat configuration.

5. The container of claim 4 which is made of a biaxially oriented material selected from the group consisting of polyethylene, polypropylene, and copolymers thereof.

6. The container of claim 5 in which said lines of folding weakness positioned transversely to the major axis of said oval shoulder exhibit a minimum thickness of 0.005 to 0.007 inch, while the wall thickness adjacent said transversely positioned lines of folding weakness is from 0.008 to 0.013 inch thick.

7. The container of claim 6 in which said lines of folding weakness positioned longitudinally of the major axis of said oval shoulder portion exhibit a minimum thickness of 0.008 to 0.013 inch, while the wall thickness adjacent said longitudinally positioned lines of weakness is 0.011 to 0.033 inch thick.

* * * * *